US006565091B2

(12) United States Patent
Weingardt

(10) Patent No.: US 6,565,091 B2
(45) Date of Patent: May 20, 2003

(54) BINGO GAME METHOD

(76) Inventor: Gary Weingardt, 5416 Gipsy Ave., Las Vegas, NV (US) 89107

( * ) Notice: Subject to any disclaimer, the term of this patent is extended or adjusted under 35 U.S.C. 154(b) by 0 days.

(21) Appl. No.: 09/745,706

(22) Filed: Dec. 26, 2000

(65) Prior Publication Data

US 2002/0117803 A1 Aug. 29, 2002

(51) Int. Cl.[7] ..... A63F 3/06
(52) U.S. Cl. ..... 273/269; 273/274
(58) Field of Search ..... 273/269, 270

(56) References Cited

U.S. PATENT DOCUMENTS 3,589,729 A * 6/1971 Girard
4,019,744 A * 4/1977 Banyai
4,252,322 A * 2/1981 Orter
5,160,146 A * 11/1992 Greer
5,338,042 A * 8/1994 Greer
5,482,289 A 1/1996 Weingardt
5,624,119 A 4/1997 Leake
5,727,786 A 3/1998 Weingardt
5,823,534 A * 10/1998 Banyai
5,909,875 A * 6/1999 Weingardt

* cited by examiner

*Primary Examiner*—William M. Pierce
(74) *Attorney, Agent, or Firm*—Jeffrey Weiss; Harry M. Weiss; Weiss, Moy & Harris, P.C.

(57) ABSTRACT

A bingo game in which bingo numbers are assigned to at least five different groups. The groups are preferably identified by color, and the size of the groups preferably vary, with the result that a bingo consisting of a combination of numbers from the smallest group will be harder to achieve than a bingo consisting of a combination of numbers from a larger group. The jackpot sizes will vary in relation to the difficulty of achieving a particular bingo. The group sizes are within certain preferred ranges, designed to minimize the risk of premature bingos and thus to increase jackpot size and player excitement. Preferably, image type indicia are also added to certain of the numbers, creating additional bingo combinations and jackpot opportunities.

9 Claims, 8 Drawing Sheets

100

| | | | | | | | | | | | | | | |
|---|---|---|---|---|---|---|---|---|---|---|---|---|---|---|
| B | 1A | 2B | 3C | 4D | 5E | 6E | 7E | 8D | 9C | 10A | 11C | 12B | 13E | 14D | 15D |
| I | 16B | 17A | 18D | 19D | 20E | 21D | 22E | 23D | 24B | 25B | 26E | 27E | 28C | 29D | 30C |
| N | 31B | 32D | 33E | 34E | 35D | 36E | 37E | 38E | 39A | 40E | 41D | 42C | 43B | 44D | 45C |
| G | 46D | 47A | 48C | 49D | 50E | 51E | 52E | 53A | 54B | 55B | 56D | 57C | 58E | 59D | 60D |
| O | 61C | 62A | 63E | 64D | 65B | 66E | 67E | 68D | 69D | 70C | 71E | 72E | 73E | 74E | 75C |

FIG. 1

100a

| | | | | | | | | | | | | | | |
|---|---|---|---|---|---|---|---|---|---|---|---|---|---|---|
| B | 1A | 2B | 3C | 4D | 5AE | 6E | 7E | 8D | 9C | 10A | 11C | 12B | 13E | 14D | 15D |
| I | 16B | 17A | 18D | 19D | 20E | 21D | 22E | 23D | 24B | 25B | 26E | 27E | 28C | 29D | 30C |
| N | 31B | 32D | 33E | 34E | 35D | 36E | 37E | 38E | 39A | 40E | 41D | 42C | 43B | 44D | 45C |
| G | 46D | 47A | 48C | 49D | 50E | 51E | 52E | 53A | 54B | 55B | 56D | 57C | 58E | 59D | 60D |
| O | 61C | 62A | 63E | 64D | 65B | 66E | 67E | 68D | 69D | 70C | 71E | 72E | 73E | 74E | 75C |

FIG. 2

200

| | | | | |
|---|---|---|---|---|
| 5 | | | | |
| | 17 | | | |
| | | Free | | |
| | | | 39 | |
| | | | | 47 |

FIG. 3a

210

| | | | | |
|---|---|---|---|---|
| 5 | | | | |
| | 13 | | | |
| | | Free | | |
| | | | 73 | |
| | | | | 52 |

FIG. 3b

220

| | | | | |
|---|---|---|---|---|
| | | | | |
| | | | | |
| | | Free ABCDE | | |
| | | | | |
| | | | | |

FIG. 4a

230

| | | | | |
|---|---|---|---|---|
| | | | | |
| | | | | |
| | | Free BCDE | | |
| | | | | |
| | | | | |

FIG. 4b

240

| | | | | |
|---|---|---|---|---|
| | | | | |
| | | | | |
| | | Free CDE | | |
| | | | | |
| | | | | |

FIG. 4c

BINGO GAME METHOD

FIELD OF THE INVENTION

This invention relates generally to bingo games, and more particularly to a bingo game that utilizes colored numbers, numbers with indicia, and other features designed to increase the attractiveness and excitement of the game to the players.

BACKGROUND OF THE INVENTION

Conventional bingo is a well known game. Players are provided with bingo cards that have a matrix of five rows and five columns. The columns are lettered B I N G O from left to right across the top of the matrix and each bingo card has five numbers in each row except the center N column which has a "free space" at the intersection of the third row and the third column.

Bingo balls individually numbered 1–75 are mixed together and balls are selected one at a time. As each ball is selected, the number is announced to the players, who cover any corresponding number on their bingo card. When a player achieves a predetermined arrangement of covered spots on his bingo card, that player yells out "Bingo!" and he wins the game.

In the conventional manner of play of bingo, in order to win the game, a player must cover five spaces in a vertical column, a horizontal row or along one of the two diagonals of the bingo card. The free space in the center of the bingo card allows a player to win with as few as four numbers being drawn. Other winning combinations include the four corners of the bingo card and the eight numbers immediately adjacent and surrounding the free space. Winning combinations can also include the covering of spots on the bingo card so that letter symbols are formed such as an X, U, L, H or T.

The operator of the bingo game will designate at the beginning of the game which particular combination or combinations of covered spots will be winning combinations for that particular game. It is also popular to play "coverall" or "blackout" games in which all of the spots on the bingo card must be covered (the twenty-four spots having numbers and the center free space) in order for the player to win.

Bingo can be played as an amusement game, but it is quite popular as a form of gambling. Players purchase bingo cards for use during the bingo session and winning players receive payouts from the operator or gaming establishment. Typically, a bingo session includes a number of individual bingo games concluding with a coverall game in which a large prize is awarded. Some operators also offer a jackpot prize if the coverall is achieved within a fixed number of called numbers, e.g. 50.

It is also known to add an extra colored bingo ball to the seventy-five numbered balls. The colored ball acts as a wild card or wild number and, if this colored ball is drawn, a player may cover any number he chooses on the bingo card.

Several variations are played of the standard bingo that uses seventy-five numbers and a five-by-five matrix bingo card. One variation is a 3-by-3 matrix bingo card with or without a free space. Another variation is known as Lightning Bingo or Speed Bingo, and is quite popular in Indian reservations. In Lightning or Speed Bingo, there is a pool of thirty numbers, e.g. balls numbered 1–30 without letter designations. Each player has a bingo card with only three numbers thereon, generally set out in a horizontal pattern. In Lightning Bingo, the caller draws numbers sequentially from the pool of thirty numbers and a player wins when he achieves all three numbers called on his bingo card.

Still another variation is known as English Bingo and is generally played in England and other parts of Europe as well as on other continents. In English Bingo, there is a pool of ninety numbers, e.g. balls numbered 1–90 without letter designations. Each player has a bingo card with multiple horizontal rows, each row having five numbers therein with the rest of the row comprising one or more blank (free) spaces. In English Bingo, the caller draws numbers sequentially from the pool of ninety numbers and a player wins when he achieves all five numbers called on a single row of his bingo card.

In relative terms, bingo as it is currently conducted in gaming casinos is a low payout game. During each bingo game, numbers are drawn until a player wins, so the gaming establishment is limited in the amount of money it can award as prizes. During a regular bingo game in which the winning bingo combination is simply five covered spots in a row vertically, diagonally or horizontally, a winning player can expect to receive a $500.00 payout. The jackpot coverall game at the end of a session may pay out $1,000.00 to the winning player. If a typical bingo session has ten regular games and a single jackpot coverall game, the gaming establishment has guaranteed to pay out $6,000.00 to the players.

The revenue to the gaming establishment is based on the number of bingo cards that are bought by the players. Since the prize fund is guaranteed at a fixed amount, the more bingo cards a gaming establishment can sell, the better the profit will be.

With few exceptions, conventional bingo has remained relatively unchanged for many years. As legalized gaming expands into more and more jurisdictions and as Indian gaming becomes more widespread, there is a need to increase the attractiveness of bingo in order to interest more players to participate in the game.

One example of an attempt to make bingo more exciting has been the payout of larger jackpot payouts for coveralls achieved in a predetermined number of selected numbers. It takes at least twenty-four drawn numbers to achieve a coverall and typically most bingo operators select a number between fifty and fifty-five as the number of balls in which the coverall is achieved in order for the player to win the large jackpot, say $5,000.00. If a coverall is not achieved within this preset number requirement, then the payout reverts to the smaller jackpot amount, say $1,000.00, for the player who achieves the coverall.

Electronic bingo represents another improvement. With the advent of electronic bingo, players are able to play virtually an unlimited number of bingo cards, thus increasing their chances of hitting a bingo. With all the positive aspects of electronic bingo, it is still limited in the size and amount of the payouts that can be made since there is a cap on the total of bingo ball numbers (seventy-five) available to be chosen and a limited number of locations to hit these numbers (24 spaces). These limitations along with the free space greatly affect the amount of the jackpot prize that can currently be awarded.

Another example is provided by U.S. Pat. No. 5,727,786, issued to the applicant herein. U.S. Pat. No. 5,727,786 is directed to a bingo game in which the bingo numbers are color-coded. In the preferred embodiment, the seventy-five bingo ball numbers are divided into four or more groups of colored spaces, with a player having the ability to achieve a higher payout by achieving a bingo based all on one color—and the highest payout by achieving a single color bingo where the color achieved is that represented by the fewest number of bingo balls. Other variations are also disclosed in U.S. Pat. No. 5,727,786.

While U.S. Pat. No. 5,727,786 represents a significant improvement to the basic game of bingo, there is room for further improvement. For example, experience has shown that four color bingo as described in U.S. Pat. No. 5,727,786 can trigger jackpots too quickly, with the result that the jackpot does not have the chance to build to a level that generates high levels of player enthusiasm.

Thus, even despite recent improvements, there is a need to further increase the player appeal of bingo in order to generate increased revenues from the operation of the game. Increased player participation would allow the payment of higher payouts which in turn would generate more player participation.

SUMMARY OF THE INVENTION

It is an object of the present invention to provide a method of playing bingo and an improved bingo game that will increase the player participation in the game.

It is a further object of the present invention to increase the popularity of bingo by increasing the difficulty factor of getting a jackpot, to allow for prizes high enough to attract gamblers away from other types of gaming such as video poker, slot machines and live table games, and to compete with lotteries.

It is a still further object of the present invention to provide a bingo game and method in which the bingo numbers/balls are divided into at least five color groups, with specific ranges allotted to each group of colors.

It is yet a further object of the present invention to provide a bingo game and method in which the number of numbers/balls assigned to a color group can be increased during the game, to increase player excitement and make a jackpot more easy to obtain.

It is a further object of the present invention to provide a bingo game and method in which the free space can be assigned to one or more of the color groups, to make a jackpot harder or easier to obtain, as desired.

It is still a further object of the present invention to assign indicia in attention to or in lieu of coloring to some or all of the numbers/balls, to provide more types of bingos and more jackpot possibilities and to otherwise increase player excitement and interest.

Other objects, features and advantages of the present invention will become apparent from a consideration of the following detailed description.

BRIEF DESCRIPTION OF THE PREFERRED EMBODIMENTS

In accordance with one embodiment of the present invention, a method of playing a game of bingo is disclosed. The method comprises the steps of: a) providing a player with a bingo card having a plurality of numbered spaces used in the play of a bingo game; b) providing a plurality of bingo balls each having individual numbers corresponding to the numbered spaces on the bingo card; c) providing an electronic number reader board having a plurality of numbered spaces corresponding to the number of bingo balls used in the bingo game; d) initiating the bingo game; e) randomly designating between one and seventy-one of the numbered spaces on the bingo board with a first designated marking; f) randomly designating between one and seventy-one of the numbered spaces on the bingo board with a second designated marking; g) randomly designating between one and seventy-one of the numbered spaces on the bingo board with a third designated marking; h) randomly designating between one and seventy-one of the numbered spaces on the bingo board with a fourth designated marking; i) randomly designating between one and seventy-one of the numbered spaces on the bingo board with at least a fifth designated marking; k) randomly selecting consecutive bingo balls; l) if the player achieves a predetermined winning combination on the bingo card of selected numbers having only the first designated marking, awarding the player a first amount; m) if the player achieves a predetermined winning combination on the bingo card of selected numbers having only the second designated marking, awarding the player a second amount; n) if the player achieves a predetermined winning combination on the bingo card of selected numbers having only the third designated marking, awarding the player a third amount; o) if the player achieves a predetermined winning combination on the bingo card of selected numbers having only the fourth designated marking, awarding the player a fourth amount; and p) if the player achieves a predetermined winning combination on the bingo card of selected numbers having only the fifth designated marking, awarding the player a fifth amount.

BRIEF DESCRIPTION OF THE DRAWINGS

FIG. 1 shows an electronic bingo number display board programmed to show each game which bingo numbers have been selected as the first group of numbers, the second group of numbers, the third group of numbers, the fourth group of numbers, and the fifth group of numbers.

FIG. 2 shows an electronic bingo number display board like that shown in FIG. 1, where one number has been split so that it now falls within two groups of numbers.

FIG. 3*a* shows a bingo card for a game corresponding to the group selections shown in FIG. 2, illustrating a first possible color bingo if the split number is the last number called.

FIG. 3*b* shows a bingo card for a game corresponding to the group selections shown in FIG. 2, illustrating a second possible color bingo if the split number is the last number called.

FIG. 4*a* shows a bingo card in which the free space can be used for any of five groups of numbers.

FIG. 4*b* shows a bingo card in which the free space can be used for any of four groups of numbers.

FIG. 4*c* shows a bingo card in which the free space can be used for any of three groups of numbers.

DETAILED DESCRIPTION OF THE PREFERRED EMBODIMENTS

Figure 4D:
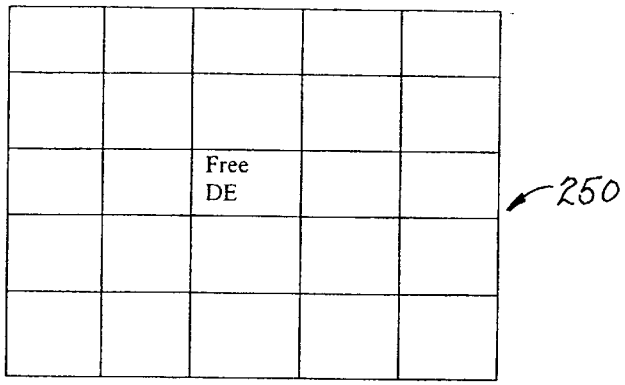
FIG. 4*d* shows a bingo card in which the free space can be used for any of two groups of numbers.
Figure 4E:
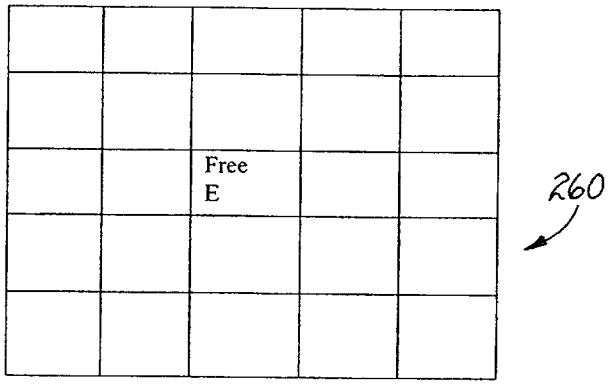
FIG. 4*e* shows a bingo card in which the free space can be used for one group of numbers.
Figure 4F:
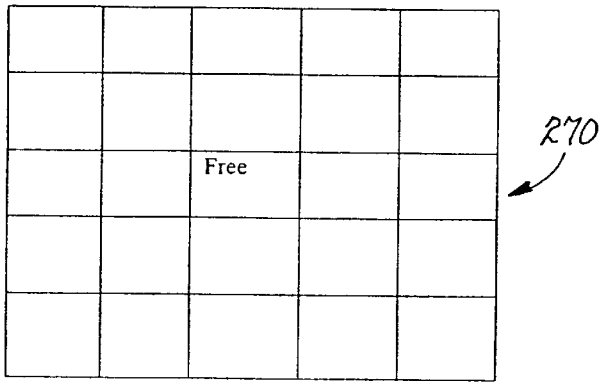
FIG. 4*f* shows a bingo card in which the free space cannot be used for any group of numbers.

FIG. 1 shows the electronic bingo number display board 100 that is used in the room or hall in which the bingo game is being conducted. The display board 100 is modeled after a conventional electronic bingo display board used in seventy-five number bingo in that there are five rows designated B, I, N, G and O, with each row having the fifteen numbers that comprise a conventional seventy-five number bingo set.

The electronic controls that operate this bingo board 100 include a conventional random number generator that is programmed to randomly select from the seventy-five number set five groups of bingo numbers to be designated as the first specially designated numbers, the second specially designated numbers, the third specially designated numbers, the fourth specially designated numbers, and the fifth specially designated numbers for a particular game.

In the preferred embodiment of the present invention, the five groups of specially designated numbers are allocated as follows:

| Group of Specially Designated Numbers | Color Assignment | Preferred Number of Balls | Optimum Range of Number of Balls | Possible Range of Number of Balls |
|---|---|---|---|---|
| First | Blue (A) | 7 | 1 to 11 | 1 to 71 |
| Second | Green (B) | 10 | 5 to 20 | 1 to 71 |
| Third | Purple (C) | 12 | 7 to 25 | 1 to 71 |
| Fourth | Red (D) | 21 | 15 to 30 | 1 to 71 |
| Fifth | Yellow (E) | 25 | 15 to 40 | 1 to 71 |

For example, as shown in FIG. 1, 7 numbers have been designated as "blue" numbers, as indicated by the suffix A; 10 numbers are designated as "green" numbers, as indicated by the suffix B; 12 numbers have been designated as "purple" numbers, as indicated by the suffix C; 21 numbers have been designated as "red" numbers, as indicated by the suffix D; and 25 numbers have been designated as "yellow" numbers, as indicated by the suffix E. Of course, there is nothing critical about the use of "blue", "green," "purple," "red" and "yellow" as the designators for the numbers on the electronic reader board 100. Indeed, markings other than colors may also be used, such as images, logos, etc., and the term "color" as used herein should be construed broadly to include any additional identifying designation added to a bingo number. In short, any suitable markings can be used, as long as the players can differentiate between the markings on the reader board 100. It should be noted further that the optimum ranges provided may be departed from slightly in either direction without departing from the spirit or scope of the present invention.

In the preferred embodiment, the electronic controls that operate the electronic bingo board illuminate the selected "blue" numbers as the color blue, the selected "green" numbers as the color green, the selected "purple" numbers as the color purple, and the selected "red" numbers as the color red. Each player can then see at the beginning of a game which of the bingo numbers have the various distinctive markings.

The game then begins in the conventional manner with the bingo caller announcing which bingo numbers have been selected sequentially during the play of the game. As soon as a player achieves a BINGO, the player calls this out and a determination is made as to whether the player has achieved a regular bingo or one of the special bingos that can be achieved. The amount of the prize that the player wins depends on the color markings on the reader board of the numbers that the player used to achieve a BINGO.

If the player has a BINGO in which all or other pre-selected portion of his winning numbers are "blue" numbers, then the player can be paid a first award. If the player has a BINGO in which all or other pre-selected portion of his winning numbers are "green" numbers, then the player can be paid a second award. If the player has a BINGO in which all or other pre-selected portion of his winning numbers are "purple" numbers, then the player can be paid a third award. If the player has a BINGO in which all or other pre-selected portion of his winning numbers are "red" numbers, then the player can be paid a fourth award. If the player has a bingo in which all or other pre-selected portion of his winning numbers are "yellow" numbers, then the player can be paid a fifth award. Finally, if the player has a bingo in which all or other pre-selected portion of his winning numbers include two or more of the colors (a "mixed color" bingo), then the player can be paid a sixth award.

Figure 6:
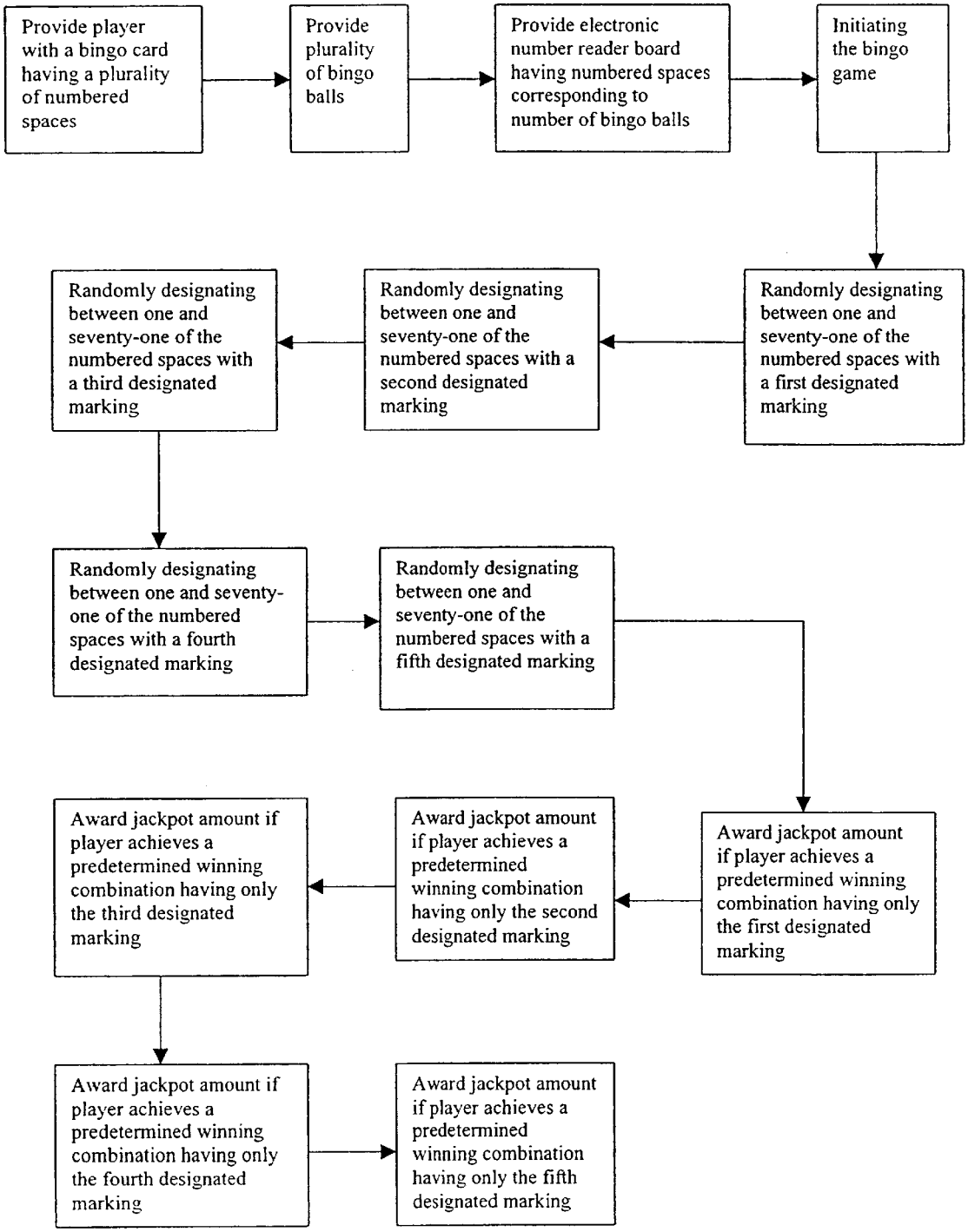
FIG. 6 shows a flow chart depicting a method of play of the present invention.
Figure 7:
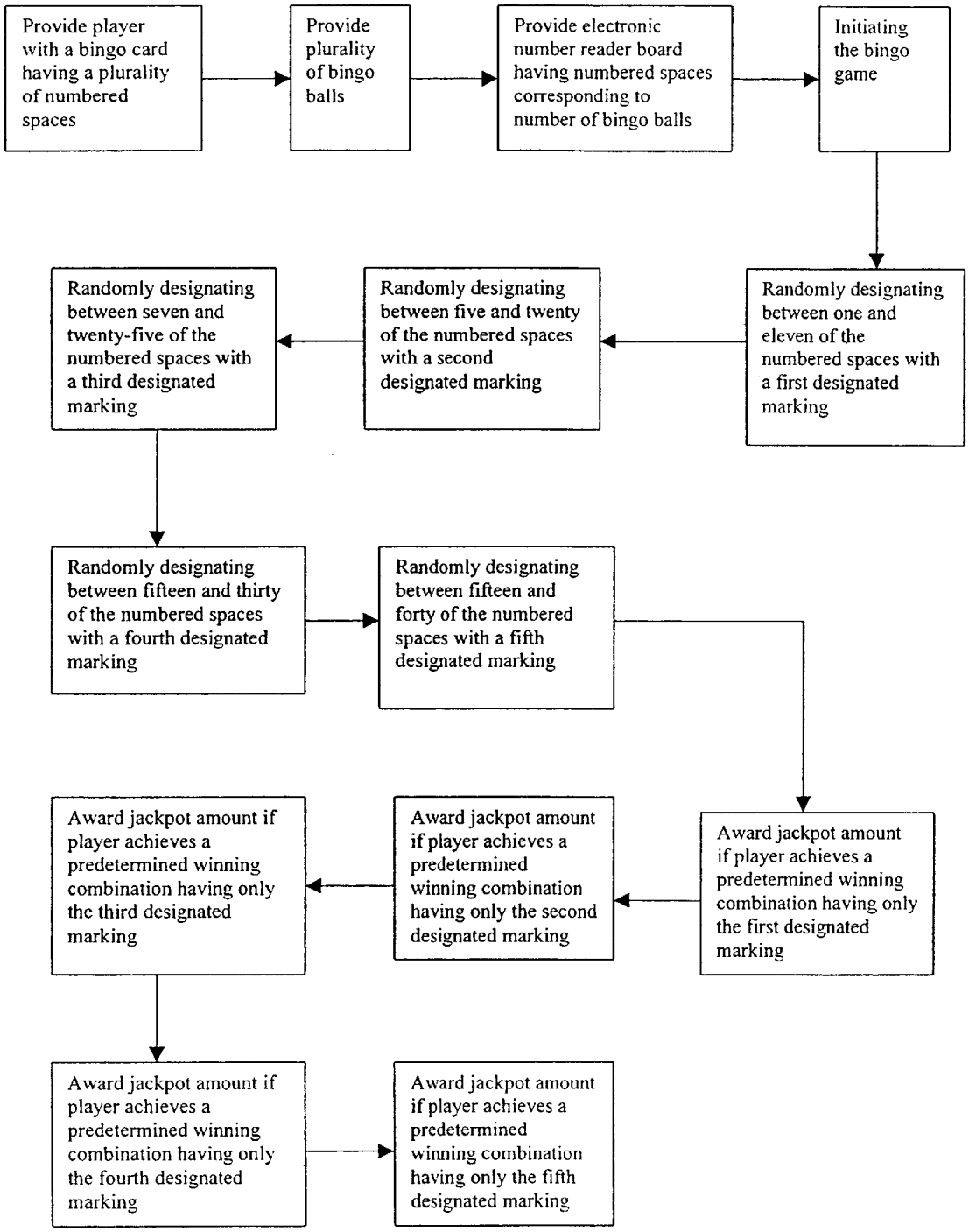
FIG. 7 shows a flow chart depicting another method of play of the present invention.
Figure 8:
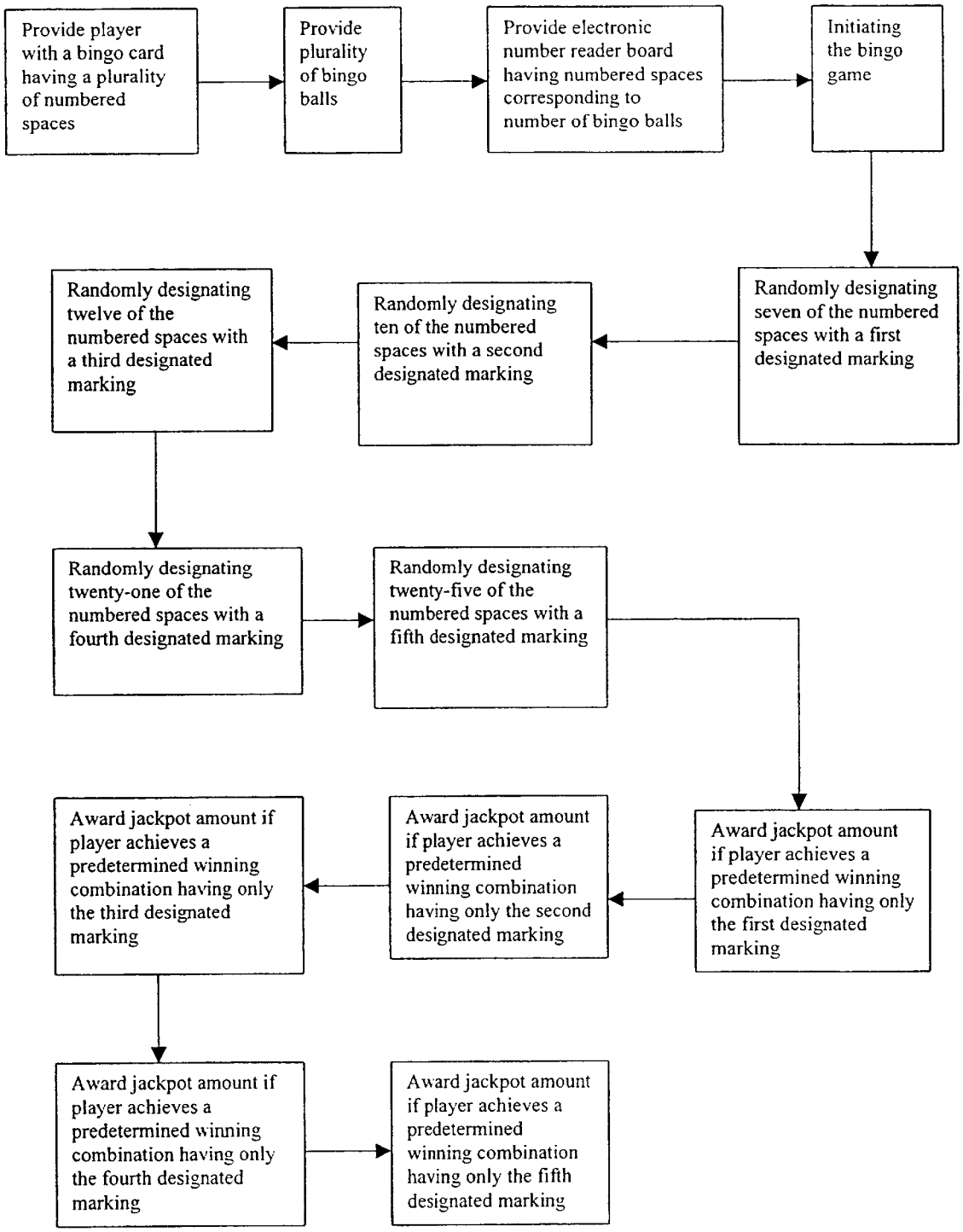
FIG. 8 shows a flow chart depicting another method of play of the present invention.

The operation of a bingo game utilizing the method of the present invention is depicted in the flow charts in FIGS. 6–8. As shown in FIGS. 6–8, the player is provided with a bingo card having a plurality of numbered spaces and a plurality of bingo balls are also provided. An electronic number reader board having numbered spaces corresponding to the number of bingo balls is positioned in the gaming establishment for viewing by each of the players. Before the beginning of each bingo game, the electronic control system randomly designates a portion of the numbered spaces on the bingo board with a first designated marking, a portion of the numbered spaces on the bingo board with a second designated marking, a portion of the numbered spaces on the bingo board with a third designated marking, a portion of the numbered spaces on the bingo board with a fourth designated marking, and a portion of the numbered spaces on the bingo board with a fifth designated marking. (The difference in number of spaces designated, as set forth in the table above, are illustrated in FIGS. 6–8, with FIG. 6 showing the full range of designation possibilities, FIG. 7 showing the optimum range, and FIG. 8 showing the preferred designation numbers.)

Consecutive bingo balls are then randomly selected until one of the players achieves a bingo. If the player achieves a predetermined winning combination having only the first designated marking, the player is then awarded a first jackpot amount. If the player achieves a predetermined winning combination having only the second designated marking, the player is then awarded a second amount. If the player achieves a predetermined winning combination having only the third designated marking, the player is then awarded a third amount. If the player achieves a predetermined winning combination having only the fourth designated marking, the player is then awarded a fourth amount. If the player achieves a predetermined winning combination having only the fifth designated marking, the player is then awarded a fifth amount.

Because the identification of the "blue," "green," "purple," "red" and "yellow" bingo numbers are made on the electronic reader board, it is possible to use any type of bingo card to play the method of the present invention. Hard board cards or paper cards can be used by the players and it is not necessary to have specially printed cards used for the game. Even electronic bingo stations that are now in use at which each player sits and electronically participates in the game can be used. The only modification that a bingo establishment needs to undertake to practice the method of the present invention is to install the electronic reader board that can show different designations on the numbers on the board as well as a random number generator with accompanying software to predetermine which numbers are going to have which designations for that particular game.

Preferably, all seventy five numbers are assigned to one of the five groups—as set forth in the preferred column of the table above. However, it would be possible to assign less than all of the numbers to the five groups, with some numbers being left unassigned or being assigned to a sixth, seventh, etc. group.

Referring now to FIGS. 2 and 3, another embodiment of the present invention is shown. Sometimes, the operator of a bingo game might want to force a jackpot to be won more quickly, perhaps as a means of increasing player excitement. The jackpot that is to be forced in this manner will be referred to as a "must go" jackpot. In one embodiment, this can be accomplished by selecting a number to be split on the reader board 100 so that it now belongs to two color (or other indicia) groups. Thus, as shown in FIG. 2, the number 5 on the reader board 100*a* which was originally assigned to the yellow group (as indicated by the suffix E) is now also assigned to the blue group A. This has the effect of making it easier to achieve a jackpot for that group which now has another number, without reducing the chance of achieving a jackpot for that group to which the split number was originally assigned.

Indeed, as shown in FIGS. 3*a* and 3*b*, two different color bingos could now be achieved simultaneously if the split number is called. As shown on the bingo card 200 in FIG. 3*a*, the calling of the number 5 could result in a blue/A bingo, and, as shown in the bingo card 210 in FIG. 3*b*, simultaneously in a yellow/E bingo. It would also be possible, if desired, to split a number into more than two groups, including for example into as many groups for which there are indicia. Although any number can be split, typically it will be desired to split a number belonging to a low jackpot group so that it now is also part of a high jackpot group, so as to increase the likelihood of achieving a high jackpot.

Alternatively, one group (preferably a high jackpot group) could be increased by simply changing a number from another group. For example, a number assigned to the yellow group can be re-assigned, in mid-game, to the blue group. This will make it easier to achieve a high jackpot blue bingo, while making it slightly more difficult to achieve a lower jackpot yellow bingo.

Referring now to FIGS. 4*a*–4*f*, it is shown how the free space found in the middle of a standard bingo card can be manipulated to make it easier or more difficult to achieve certain bingos. In standard bingo, the free space can be used to support a bingo passing through the center space, without any need for a player to wait for a particular number to be called. As shown in bingo card 220 in FIG. 4*a*, the free space can be assigned so that it is truly free—i.e., it can be used to support a bingo in any color group (A through E) that passes through the center space. As shown in FIGS. 4*b*–4*f*, the free space can be made less than fully free—with typically the higher jackpot groups being excluded from the free space first. Thus, as shown in bingo card 230 in FIG. 4*b*, the free space can be assigned so that it will support a bingo in four color groups (e.g., B through E). As shown in bingo card 240 in FIG. 4*c*, the free space can be assigned so that it will support a bingo in three color groups (e.g., C through E). As shown in bingo card 250 in FIG. 4*d*, the free space can be assigned so that it will support a bingo in two color groups (e.g., D through E). As shown in bingo card 260 in FIG. 4*e*, the free space can be assigned so that it will support a bingo in one color group (e.g., E). As shown in bingo card 270 in FIG. 4*f*, the free space can be assigned so that it will not support a bingo in any color group.

Figure 5A:
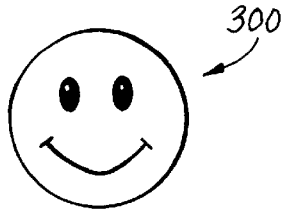
FIG. 5*a* shows an image type of indicia that can be placed on one or more numbers.
Figure 5B:
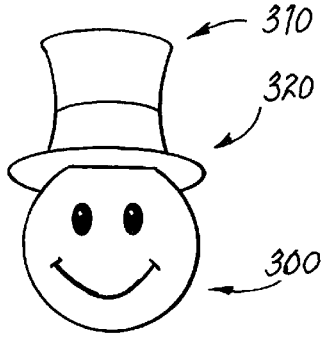
FIG. 5*b* shows an image type of indicia that can be placed on a sub-group of the numbers having the indicia of FIG. 5*a* thereon.
Figure 5C:
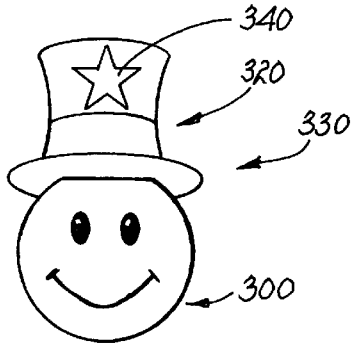
FIG. 5*c* shows an image type of indicia that can be placed on a sub-group of the numbers having the indicia of FIG. 5*b* thereon.
Figure 9:
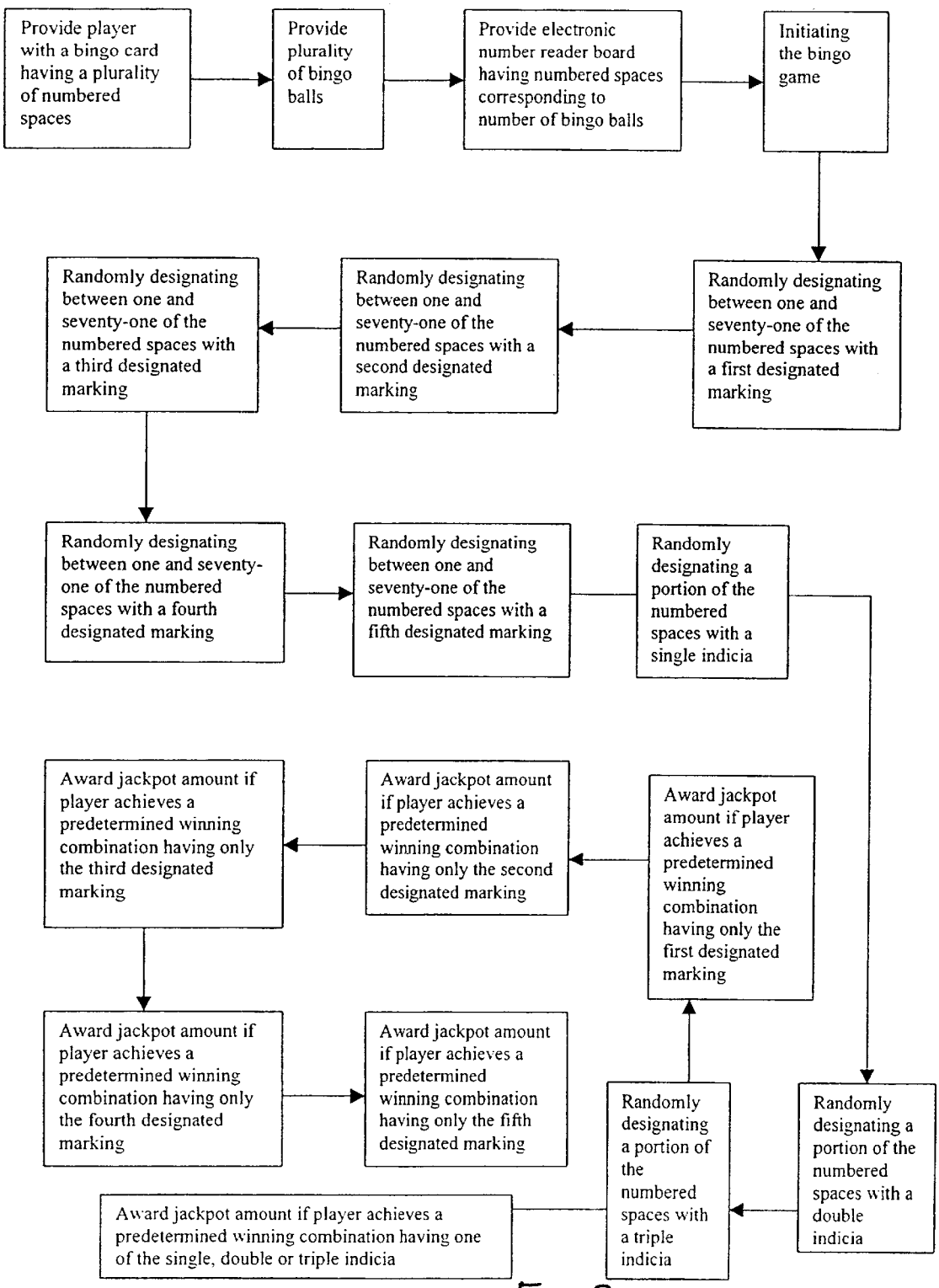
FIG. 9 shows a flow chart depicting another method of play of the present invention.

Referring now to FIGS. 5*a*–5*b*, another embodiment of the present invention is shown. This embodiment can be used in combination with that of FIGS. 1–4*f*, or by itself. Referring first to FIG. 5*a*, it is possible to place a single indicia 300, such as a smiley face, on a group of numbers, e.g., on fifteen of the seventy-five numbers. It would be possible further, as shown in FIG. 5*b*, to place a double indicia 310, consisting of the combination of the single indicia 300 and a second indicia 320 (here shown as a hat), on a sub-group of the numbers having the single indicia 300, e.g., on ten of the fifteen numbers having single indicia 300. It would be possible further, as shown in FIG. 5*c*, to place a triple indicia 330, consisting of the combination of the single indicia 300, the double indicia 310, and a third indicia 340 (here shown as a star on the hat) on a sub-group of the numbers having the double indicia 310 e.g., on five of the ten numbers having double indicia 310. The process could be continued further, with quadruple, quintuple, and so forth indicia.

Where the embodiment of FIGS. 5*a*–5*c* is used in combination with the group embodiments discussed above, it can be seen that additional jackpot opportunities can be created. Thus, in addition to, for example, the five ascending jackpots from yellow to blue, a person could additionally achieve a jackpot for having a bingo consisting of numbers having single indicia 300, a different jackpot for having a bingo consisting of numbers having double indicia 310, or yet another jackpot for having a bingo consisting of numbers having triple indicia 330. Still further, there could be bonus or other jackpots for bingos in which the last number called has single indicia 300, where the last number called has double indicia 310, or where the last number called has triple indicia 330—with the bonus/jackpot being higher the lower the odds of achieving the particular bingo. The use of indicia in combination with the color groups of FIGS. 1–4*f* is illustrated in the flow chart in FIG. 9. Where the indicia of FIGS. 5*a*–5*b* are used independently of the color groups of FIGS. 1–4*f*, there will be fewer potential jackpots, but the same principles will apply—with jackpot possibilities being created depending on whether a bingo is achieved with numbers having single indicia 300; numbers having double indicia 310; numbers having triple indicia 330; numbers having a combination of single, double and/or triple indicia 300, 310 and 330; or where the last number called has single, double, or triple indicia 300, 310 or 330.

The size of the awards to the players for the various "one color" bingos, "mixed color" bingos, indicia bingos or combination color/indicia bingos can be determined by the gaming establishment. In one embodiment of the present invention, these awards can be fixed amounts. Alternatively, progressive jackpot pools may be established so that the amount of the award increases over time and this will increase the attractiveness of the game to the players. The funding for these progressive jackpot pools can come from the regular buy-in to play the game or a separate buy-in can be created. These are discussed in more detail in U.S. Pat. Nos. 5,482,289 (Weingardt) and 5,727,786 (Weingardt), incorporated herein by this reference.

Furthermore, another payout pool can be established to pay any player who achieves a "case bingo." A "case bingo" is achieved whenever a player is one number short of having a pre-established winning bingo arrangement. The "case bingo" winners are determined after a winning bingo arrangement occurs during a particular round of play and the "case bingo" payout pool is split up among those players qualifying with "case bingos."

Alternatively, one large progressive pool can be established and various flat amounts or percentages of this pool can be paid to a player who achieves one of the predetermined bingo combinations.

The method of the present invention can also be applied to a form of bingo known as English Bingo. In English Bingo, there is a pool of ninety numbers, e.g. balls numbered 1–90. In English Bingo, the caller draws numbers sequentially from the pool of ninety numbers and a player wins when he achieves all five numbers called on a single row of his bingo card. Similarly to the invention described above in connection with FIGS. 1–5*c*, an electronic reader board for English Bingo can use a random number generator to designate some of the ninety numbers as "blue" numbers, some as "green" numbers, some as "purple" numbers, some as "red" numbers, and some as "yellow" numbers. Additionally, some of the numbers can be designated as having single indicia, double indicia, or triple indicia, as shown in FIGS. 5*a*–5*c*.

The progressive pools used with the electronic reader board version of English Bingo can take any suitable format and can be similar in format and use as described above in connection with FIGS. 1–3.

The method of the present invention can also be applied to a form of bingo known as Lightning Bingo or Speed Bingo. In Lightning or Speed Bingo, there is a pool of thirty numbers, e.g. balls numbered 1–30 without letter designations. Each player has a bingo card with only three numbers thereon, generally set out in a vertical pattern. In Lightning Bingo, the caller draws numbers sequentially from the pool of thirty numbers and a player wins when he achieves all three numbers called on his bingo card. Similarly to the invention described above in connection with FIGS. 1–3, the electronic reader board for Lightning Bingo uses a random number generator to designate some of the thirty numbers as "blue" numbers, some of the other thirty numbers as "green"numbers, some of the other thirty numbers as "purple" numbers, some of the other thirty numbers as "red" numbers, and some of the other thirty numbers as "yellow" numbers. Additionally, some of the assigned numbers may further be designated using indicia as discussed above with respect to FIGS. 5*a*–5*c*.

Optionally, after the bingo game is initiated, the electronic control system may also randomly designates a portion of the numbered spaces on the bingo board with a single indicia 300, a portion of the numbered spaces with a double indicia 310, and a portion of the numbered spaces with a triple indicia 330. Consecutive bingo balls are then randomly selected, as described above, until one of the players achieves a bingo. A bingo can be defined as desired, including a predetermined winning combination having only a designated marking and a single indicia 300, a designated marking and a double indicia 310, a designated marking and a triple indicia 330; a bingo in which the last number called is one of a single indicia 300, a double indicia 310, or a triple indicia 330; or some combination of single indicias 300, double indicia 310, and triple indicias 330.

While the invention has been illustrated with respect to several specific embodiments thereof, these embodiments should be considered as illustrative rather than limiting. Various modifications and additions may be made and will be apparent to those skilled in the art. For example, while the invention has been described with respect to the game of bingo, it should be understood that the same method of applying five or more designated markings to a number board and designating spaces on a number board with single, double, and/or triple indicia may be used for similar games, such as Keno. Accordingly, the invention should not be limited by the foregoing description, but rather should be defined only by the following claims.

I claim:

1. A method of playing a game of bingo comprising:

a) providing a player with a bingo card having a plurality of numbered spaces used in the play of a bingo game;

b) providing a plurality of bingo balls each having individual numbers corresponding to the numbered spaces on the bingo card;

c) providing an electronic number reader board having a plurality of numbered spaces corresponding to the number of bingo balls used in the bingo game;

d) initiating the bingo game;

e) randomly designating between one and about eleven of the numbered spaces on the bingo board with a first designated marking;

f) randomly designating between about five and about twenty of the numbered spaces on the bingo board with a second designated marking;

g) randomly designating between about seven and about twenty five of the numbered spaces on the bingo board with a third designated marking;

h) randomly designating between about fifteen and about thirty of the numbered spaces on the bingo board with a fourth designated marking;

i) randomly designating between about fifteen and about forty of the numbered spaces on the bingo board with at least a fifth designated marking;

j) after said step of initiating said bingo game, re-assigning a numbered space assigned to one of said first, second, third, fourth, and fifth designated markings to a second of said first, second, third, fourth and fifth designated markings, by changing said one of said first, second, third, fourth and fifth designated markings on the bingo board to a second of said first, second, third, fourth and fifth designated markings;

k) randomly selecting consecutive bingo balls;

l) if the player achieves a predetermined winning combination on the bingo card of selected numbers having only the first designated marking, awarding the player a first amount;

m) if the player achieves a predetermined winning combination on the bingo card of selected numbers having only the second designated marking, awarding the player a second amount;

n) if the player achieves a predetermined winning combination on the bingo card of selected numbers having only the third designated marking, awarding the player a third amount;

o) if the player achieves a predetermined winning combination on the bingo card of selected numbers having only the fourth designated marking, awarding the player a fourth amount; and p) if the player achieves a predetermined winning combination on the bingo card of selected numbers having only the fifth designated marking, awarding the player a fifth amount.

2. The method of playing a game of bingo comprising:

a) providing a player with a bingo card having a plurality of numbered spaces used in the play of a bingo game;

b) providing a plurality of bingo balls each having individual numbers corresponding to the numbered spaces on the bingo card;

c) providing an electronic number reader board having a plurality of numbered spaces corresponding to the number of bingo balls used in the bingo game;

d) initiating the bingo game;

e) randomly designating between one and seventy-one of the numbered spaces on the bingo board with a first designated marking;

f) randomly designating between one and seventy-one of the numbered spaces on the bingo board with a second designated marking;

g) randomly designating between one and seventy-one of the numbered spaces on the bingo board with a third designated marking;

h) randomly designating between one and seventy-one of the numbered spaces on the bingo board with a fourth designated marking;

i) randomly designating between one and seventy-one of the numbered spaces on the bingo board with at least a fifth designated marking;

k) randomly selecting consecutive bingo balls;

l) splitting a numbered space assigned to one of said first, second, third, fourth, and fifth designated markings so that it is also assigned to a second of said first, second, third, fourth and fifth designated markings, by designating said split numbered space on the bingo board with two different designated markings;

m) if the player achieves a predetermined winning combination on the bingo card of selected numbers having only the first designated marking, awarding the player a first amount;

n) if the player achieves a predetermined winning combination on the bingo card of selected numbers having only the second designated marking, awarding the player a second amount;

o) if the player achieves a predetermined winning combination on the bingo card of selected numbers having only the third designated marking, awarding the player a third amount;

p) if the player achieves a predetermined winning combination on the bingo card of selected numbers having only the fourth designated marking, awarding the player a fourth amount; and q) if the player achieves a predetermined winning combination on the bingo card of selected numbers having only the fifth designated marking, awarding the player a fifth amount.

3. A method of playing a game of bingo comprising:

a) providing a player with a bingo card having a plurality of numbered spaces used in the play of a bingo game;

b) providing on said bingo card a free space supporting a bingo based on no more than one of four pre-selected designated markings out of a total of at least five pre-selected markings;

c) providing a plurality of bingo balls each having individual numbers corresponding to the numbered spaces on the bingo card;

d) providing an electronic number reader board having a plurality of numbered spaces corresponding to the number of bingo balls used in the bingo game;

e) initiating the bingo game;

f) randomly designating between one and seventy one of the numbered spaces on the bingo board with a first designated marking;

g) randomly designating between one and seventy one of the numbered spaces on the bingo board with a second designated marking;

h) randomly designating between one and seventy one of the numbered spaces on the bingo board with a third designated marking;

i) randomly designating between one and seventy one of the numbered spaces on the bingo board with a fourth designated marking;

j) randomly designating between one and seventy one of the numbered spaces on the bingo board with at least a fifth designated marking;

k) randomly selecting consecutive bingo balls;

l) if the player achieves a predetermined winning combination on the bingo card of selected numbers having only the first designated marking, awarding the player a first amount;

m) if the player achieves a predetermined winning combination on the bingo card of selected numbers having only the second designated marking, awarding the player a second amount;

n) if the player achieves a predetermined winning combination on the bingo card of selected numbers having only the third designated marking, awarding the player a third amount;

o) if the player achieves a predetermined winning combination on the bingo card of selected numbers having only the fourth designated marking, awarding the player a fourth amount; and p) if the player achieves a predetermined winning combination on the bingo card of selected numbers having only the fifth designated marking, awarding the player a fifth amount.

4. A method of playing a game of bingo comprising:

a) providing a player with a bingo card having a plurality of numbered spaces used in the play of a bingo game;

b) providing on said bingo card a free space supporting a bingo based no more than one of three pre-selected designated markings out of a total of at least five pre-selected markings;

c) providing a plurality of bingo balls each having individual numbers corresponding to the numbered spaces on the bingo card;

d) providing an electronic number reader board having a plurality of numbered spaces corresponding to the number of bingo balls used in the bingo game;

e) initiating the bingo game;

f) randomly designating between one and seventy one of the numbered spaces on the bingo board with a first designated marking;

g) randomly designating between one and seventy one of the numbered spaces on the bingo board with a second designated marking;

h) randomly designating between one and seventy one of the numbered spaces on the bingo board with a third designated marking;

i) randomly designating between one and seventy one of the numbered spaces on the bingo board with a fourth designated marking;

j) randomly designating between one and seventy one of the numbered spaces on the bingo board with at least a fifth designated marking;

k) randomly selecting consecutive bingo balls;

l) if the player achieves a predetermined winning combination on the bingo card of selected numbers having only the first designated marking, awarding the player a first amount;

m) if the player achieves a predetermined winning combination on the bingo card of selected numbers having only the second designated marking, awarding the player a second amount;

n) if the player achieves a predetermined winning combination on the bingo card of selected numbers having only the third designated marking, awarding the player a third amount;

o) if the player achieves a predetermined winning combination on the bingo card of selected numbers having only the fourth designated marking, awarding the player a fourth amount; and p) if the player achieves a predetermined winning combination on the bingo card of selected numbers having only the fifth designated marking, awarding the player a fifth amount.

5. A method of playing a game of bingo comprising:

a) providing a player with a bingo card having a plurality of numbered spaces used in the play of a bingo game;

b) providing on said bingo card a free space supporting a bingo based no more than one of two pre-selected designated markings out of a total of at least five pre-selected markings;

c) providing a plurality of bingo balls each having individual numbers corresponding to the numbered spaces on the bingo card;

d) providing an electronic number reader board having a plurality of numbered spaces corresponding to the number of bingo balls used in the bingo game;

e) initiating the bingo game;

f) randomly designating between one and seventy one of the numbered spaces on the bingo board with a first designated marking;

g) randomly designating between one and seventy one of the numbered spaces on the bingo board with a second designated marking;

h) randomly designating between one and seventy one of the numbered spaces on the bingo board with a third designated marking;

i) randomly designating between one and seventy one of the numbered spaces on the bingo board with a fourth designated marking;

j) randomly designating between one and seventy one of the numbered spaces on the bingo board with at least a fifth designated marking;

k) randomly selecting consecutive bingo balls;

l) if the player achieves a predetermined winning combination on the bingo card of selected numbers having only the first designated marking, awarding the player a first amount;

m) if the player achieves a predetermined winning combination on the bingo card of selected numbers having only the second designated marking, awarding the player a second amount;

n) if the player achieves a predetermined winning combination on the bingo card of selected numbers having only the third designated marking, awarding the player a third amount;

o) if the player achieves a predetermined winning combination on the bingo card of selected numbers having only the fourth designated marking, awarding the player a fourth amount; and p) if the player achieves a predetermined winning combination on the bingo card of selected numbers having only the fifth designated marking, awarding the player a fifth amount.

6. A method of playing a game of bingo comprising:

a) providing a player with a bingo card having a plurality of numbered spaces used in the play of a bingo game;

b) providing on said bingo card a free space supporting a bingo based on only one of one pre-selected designated markings out of a total of at least five pre-selected markings;

c) providing a plurality of bingo balls each having individual numbers corresponding to the numbered spaces on the bingo card;

d) providing an electronic number reader board having a plurality of numbered spaces corresponding to the number of bingo balls used in the bingo game;

e) initiating the bingo game;

f) randomly designating between one and seventy one of the numbered spaces on the bingo board with a first designated marking;

g) randomly designating between one and seventy one of the numbered spaces on the bingo board with a second designated marking;

h) randomly designating between one and seventy one of the numbered spaces on the bingo board with a third designated marking;

i) randomly designating between one and seventy one of the numbered spaces on the bingo board with a fourth designated marking;

j) randomly designating between one and seventy one of the numbered spaces on the bingo board with at least a fifth designated marking;

k) randomly selecting consecutive bingo balls;

l) if the player achieves a predetermined winning combination on the bingo card of selected numbers having only the first designated marking, awarding the player a first amount;

m) if the player achieves a predetermined winning combination on the bingo card of selected numbers having only the second designated marking, awarding the player a second amount;

n) if the player achieves a predetermined winning combination on the bingo card of selected numbers having only the third designated marking, awarding the player a third amount;

o) if the player achieves a predetermined winning combination on the bingo card of selected numbers having only the fourth designated marking, awarding the player a fourth amount; and p) if the player achieves a predetermined winning combination on the bingo card of selected numbers having only the fifth designated marking, awarding the player a fifth amount.

7. A method of playing a game of bingo comprising:

a) providing a player with a bingo card having a plurality of numbered spaces used in the play of a bingo game;

b) providing on said bingo card a free space excluding a bingo based on any pre-selected designated marking;

c) providing a plurality of bingo balls each having individual numbers corresponding to the numbered spaces on the bingo card;

d) providing an electronic number reader board having a plurality of numbered spaces corresponding to the number of bingo balls used in the bingo game;

e) initiating the bingo game;

f) randomly designating between one and seventy one of the numbered spaces on the bingo board with a first designated marking;

g) randomly designating between one and seventy one of the numbered spaces on the bingo board with a second designated marking;

h) randomly designating between one and seventy one of the numbered spaces on the bingo board with a third designated marking;

i) randomly designating between one and seventy one of the numbered spaces on the bingo board with a fourth designated marking;

j) randomly designating between one and seventy one of the numbered spaces on the bingo board with at least a fifth designated marking;

k) randomly selecting consecutive bingo balls;

l) if the player achieves a predetermined winning combination on the bingo card of selected numbers having only the first designated marking, awarding the player a first amount;

m) if the player achieves a predetermined winning combination on the bingo card of selected numbers having only the second designated marking, awarding the player a second amount;

n) if the player achieves a predetermined winning combination on the bingo card of selected numbers having only the third designated marking, awarding the player a third amount;

o) if the player achieves a predetermined winning combination on the bingo card of selected numbers having only the fourth designated marking, awarding the player a fourth amount; and p) if the player achieves a predetermined winning combination on the bingo card of selected numbers having only the fifth designated marking, awarding the player a fifth amount.

8. A method of playing a game of bingo comprising:

a) providing a player with a bingo card having a plurality of numbered spaces used in the play of a bingo game;

b) providing a plurality of bingo balls each having individual numbers corresponding to the numbered spaces on the bingo card;

c) providing an electronic number reader board having a plurality of numbered spaces corresponding to the number of bingo balls used in the bingo game;

d) initiating the bingo game;

e) randomly designating between one and seventy one of the numbered spaces on the bingo board with a first designated marking;

f) randomly designating between one and seventy one of the numbered spaces on the bingo board with a second designated marking;

g) randomly designating between one and seventy one of the numbered spaces on the bingo board with a third designated marking;

h) randomly designating between one and seventy one of the numbered spaces on the bingo board with a fourth designated marking;

i) randomly designating between one and seventy one of the numbered spaces on the bingo board with at least a fifth designated marking;

j) randomly selecting consecutive bingo balls;

k) if the player achieves a predetermined winning combination on the bingo card of selected numbers having only the first designated marking, awarding the player a first amount;

l) if the player achieves a predetermined winning combination on the bingo card of selected numbers having only the second designated marking, awarding the player a second amount;

m) if the player achieves a predetermined winning combination on the bingo card of selected numbers having only the third designated marking, awarding the player a third amount;

n) if the player achieves a predetermined winning combination on the bingo card of selected numbers having only the fourth designated marking, awarding the player a fourth amount; and o) if the player achieves a predetermined winning combination on the bingo card of selected numbers having only the fifth designated marking, awarding the player a fifth amount;

p) randomly designating a portion of the numbered spaces on the bingo board having said first designated marking with said second designated marking; and q) awarding the player a jackpot if the player achieves a predetermined winning combination on the bingo card of selected numbers having each of said first designated marking and said second designated marking.

9. A method of playing a game of bingo comprising:

a) providing a player with a bingo card having a plurality of numbered spaces used in the play of a bingo game;

b) providing a plurality of bingo balls each having individual numbers corresponding to the numbered spaces on the bingo card;

c) providing an electronic number reader board having a plurality of numbered spaces corresponding to the number of bingo balls used in the bingo game;

d) initiating the bingo game;

e) randomly designating between one and seventy one of the numbered spaces on the bingo board with a first designated marking;

f) randomly designating between one and seventy one of the numbered spaces on the bingo board with a second designated marking;

g) randomly designating between one and seventy one of the numbered spaces on the bingo board with a third designated marking;

h) randomly designating between one and seventy one of the numbered spaces on the bingo board with a fourth designated marking;

i) randomly designating between one and seventy one of the numbered spaces on the bingo board with at least a fifth designated marking;

j) randomly selecting consecutive bingo balls;

k) if the player achieves a predetermined winning combination on the bingo card of selected numbers having only the first designated marking, awarding the player a first amount;

l) if the player achieves a predetermined winning combination on the bingo card of selected numbers having only the second designated marking, awarding the player a second amount;

m) if the player achieves a predetermined winning combination on the bingo card of selected numbers having only the third designated marking, awarding the player a third amount;

n) if the player achieves a predetermined winning combination on the bingo card of selected numbers having only the fourth designated marking, awarding the player a fourth amount; and o) if the player achieves a predetermined winning combination on the bingo card of selected numbers having only the fifth designated marking, awarding the player a fifth amount;

p) randomly designating a portion of the numbered spaces on the bingo board having said first designated marking with each of said second designated marking and said third designated marking; and q) awarding the player a jackpot if the player achieves a predetermined winning combination on the bingo card of selected numbers having at least each of said first designated marking, said second designated marking and said third designated marking.

* * * * *